United States Patent [19]

Pockman et al.

[11] 4,107,912

[45] Aug. 22, 1978

[54] METERING CAPSTAN

[76] Inventors: William W. Pockman; Thomas W. Pockman, both of 2872 Quail Hollow Rd., Clearwater, Fla. 33519

[21] Appl. No.: 793,410

[22] Filed: May 3, 1977

[51] Int. Cl.[2] ..... D01H 13/04

[52] U.S. Cl. ..... 57/68; 57/90; 57/156; 226/190; 254/150 R; 254/190 R

[58] Field of Search ..... 57/68, 90, 34 R, 156; 226/190; 242/47.01, 47.12, 47.13; 254/150 R, 175.3, 190 R

[56] References Cited

U.S. PATENT DOCUMENTS

| | | | |
|---|---|---|---|
| 994,576 | 6/1911 | Dawes | 57/68 |
| 2,506,942 | 5/1950 | Seeburg | 254/175.3 |
| 2,836,983 | 6/1958 | Stewart | 242/47.12 X |
| 3,329,406 | 7/1967 | Flair | 254/175.3 |
| 3,728,854 | 4/1973 | Ramunas | 57/68 |
| 3,843,094 | 10/1974 | Watts | 242/47.01 X |
| 3,854,698 | 12/1974 | Ferrentino | 254/190 R |

*Primary Examiner*—Charles Gorenstein
*Attorney, Agent, or Firm*—Wender, Murase & White

[57] ABSTRACT

An improved capstan assembly for a rope making machine in which separate strands of rope are twisted together and drawn through a forming die by the capstan and then directed onto a take-up spool. The capstan assembly includes a single capstan having a smooth cylindrical peripheral wall and a hollow central shaft through which the advancing rope strand is directed. A separating comb is mounted adjacent the peripheral wall of the capstan such that adjacent windings of the advancing rope strand around the single capstan are engaged and kept separate by the comb teeth and thereby are prevented from overlapping and binding.

9 Claims, 2 Drawing Figures

METERING CAPSTAN

BACKGROUND OF THE INVENTION

1. Field of the Invention:

The present invention relates generally to capstan assemblies for rope making machines, and more particularly, to such assemblies having only a single capstan whereby less tensile stress is placed on the advancing rope strand.

2. Description of the Prior Art:

In the manufacture of rope, conventional equipment provides for the supply of plural strands which are fed through equipment that will put a twist into the strands at a constant speed. In accomplishing this, the individual strands are generally directed through a forming die where they are joined and twisted while being drawn through the assembly by metering capstans. In order to assure high quality in the finished product, it is imperative that both the amount of twist and the throughput of rope be maintained constant and be accurately controlled.

Both the twisting of the rope strands and the drawing of the twisted rope through the assembly are controlled by the metering capstans. Metering capstans are similarly used in braided rope making machines which do not twist the rope but draw it directly through a forming die. In both cases, slippage of the rope about the capstans must be avoided.

In prior art rope making assemblies, such as that illustrated in U.S. Pat. No. 3,728,854, two separate capstans have been used with the rope passing around both capstans. The use of two capstans has long been considered to be necessary in order to assure that adjacent windings will not pile up on each other or overlap resulting in binding. While experience has shown that the use of two capstans successfully prevents binding and overlapping, this favorable result has been accompanied by a serious disadvantage in that the tension in the rope windings must be maintained exceptionally high to preclude slipping. Thus, the design of conventional dual-capstan metering assemblies requires that a trade-off be reached between the advantage of eliminated overlapping and the disadvantage of the application of high tensile stresses.

In the early development of rope making machines, several attempts were made to use single capstans. U.S. Pat. No. 317,116, for example, discloses the use of a single capstan which is conically shaped and cooperates with a small, inclined ramp, which acts to prevent the first winding from overlapping. A similar arrangement is illustrated in U.S. Pat. No. 781,281 which again uses a conical capstan to urge the rope by self-slippage toward the reduced diameter and to prevent overlapping. In practice, neither of these approaches has proven to be fully satisfactory since they both necessitate that the rope continually slip higher and higher on the capstan in order to preclude overlapping. In practice, some overlapping does in fact occur, and the slippage makes the throughput rate difficult to accurately control.

Another example of the prior art use of single capstans is U.S. Pat. No. 994,576. In this device, a threaded drum cooperates with a flier assembly to advance the rope or yarn through the apparatus. While the threaded periphery of the drum would at first glance appear to efficiently maintain the windings separate, it is readily apparent that as the drum rotates with respect to the flier, the advancing strand may have to jump from one groove to the adjacent groove.

As the rope making industry progressed from the early machines exemplified by the above-noted patents, it was believed that the dual-capstan arrangement produced superior control and, thus, was a preferred arrangement despite the disadvantage of increased tensile stress. As a result, modern equipment, as illustrated in U.S. Pat. No. 3,728,854, typically incorporates the dual-capstan assembly.

SUMMARY OF THE INVENTION

It is an object of the present invention to facilitate the use of a single capstan in combination with a fixed separator comb for the advancement of a twisted or braided strand in a precise and controlled manner without the application of excessive tensile stress.

This invention has another object in the construction of rope making equipment which is considerably simpler than typical prior art equipment, exhibits precise twist and throughput control, and does not place the advancing rope in excessive tension.

The present invention may be summarized as a capstan assembly for a rope making machine in which the assembly includes a single capstan having a smooth cylindrical peripheral wall, the advancing rope strand being guided around the peripheral wall of the capstan; a drive assembly for rotating the capstan; and a separating comb disposed with the teeth thereof aligned substantially parallel to the capstan axis and having the distal ends thereof positioned adjacent the peripheral wall of the capstan such that adjacent windings of the advancing rope strand on the capstan are engaged and kept separate by the comb teeth and thereby are prevented from overlapping and binding.

The present invention exhibits substantial advantages over prior art devices in that the overall apparatus is simpler and more economical; that only a single capstan is required; that more precise metering of both twist and rope throughput can be achieved; and that less tensile stress is imposed upon the advancing rope strand.

Other objects and advantages of the present invention will become apparent from the following description of a preferred embodiment when taken in conjunction with the accompanying drawing.

DESCRIPTION OF A PREFERRED EMBODIMENT

Figure 1:
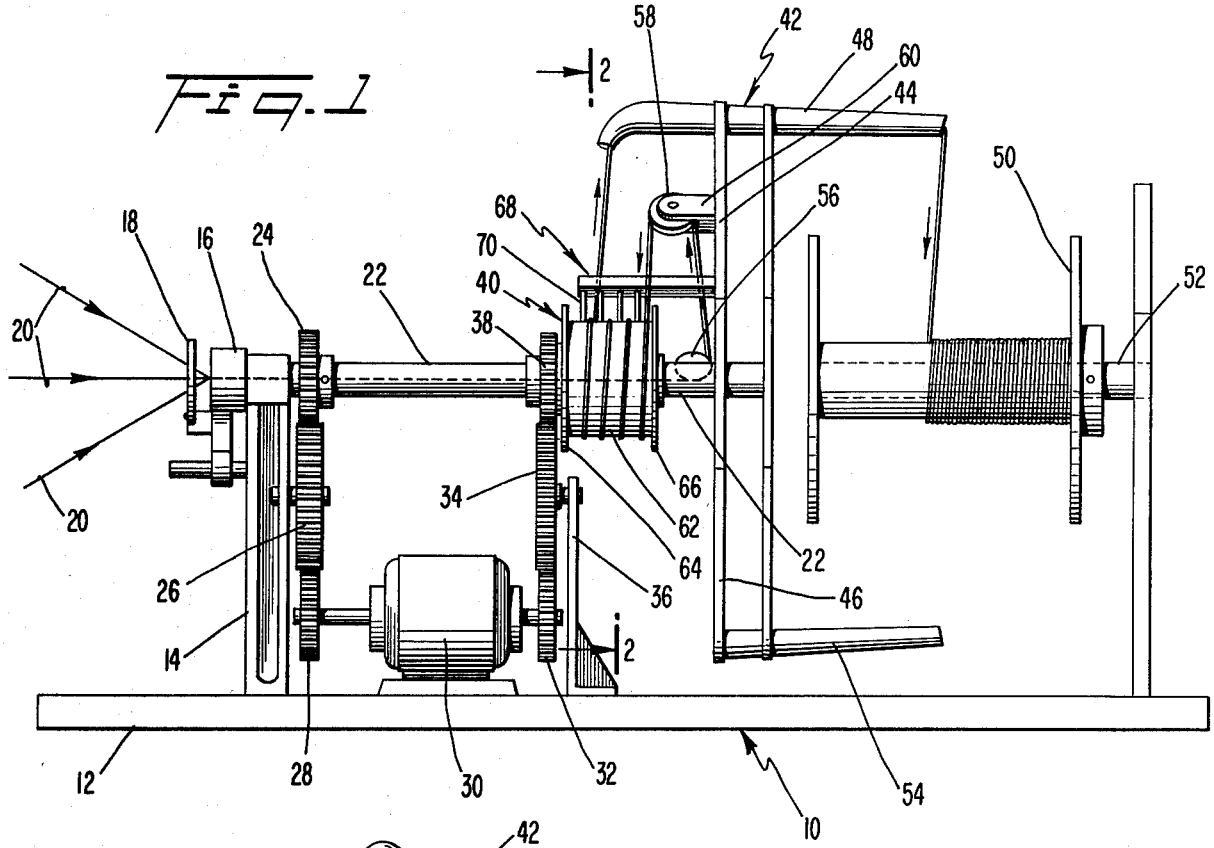
FIG. 1 is a side elevational view of a preferred embodiment of a rope making machine including a metering capstan according to the present invention.
Figure 2:
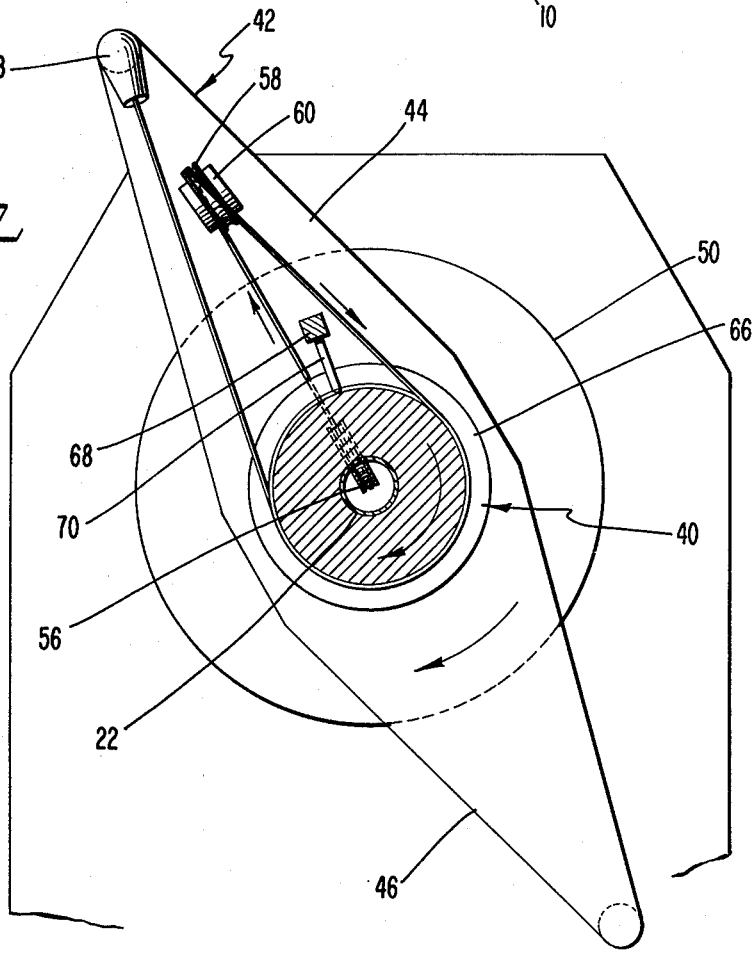
FIG. 2 is a sectional view taken along lines 2—2 of FIG. 1.

The present invention is embodied in a rope making machine, generally designated as 10 in FIGS. 1 and 2, and including a base or frame 12 having an upright arm 14 on which is supported a forming die 16. An apertured plate 18 may also be mounted in front of forming die 16 to assist in the formation of a desired twist between plural strands 20 of rope fed from conventional supply reels (not shown). Support arm 14 is journalled for rotatably supporting a hollow tube 22 having a gear wheel 24 fixedly attached to the end of the tube adjacent support 14. A gear 26 is rotatably disposed on support 14 for cooperation with gear wheel 24 and an output gear 28 of a drive motor 30.

Drive motor 30 has a second output gear 32 which cooperates with a gear wheel 34 which is rotatably disposed on a support 36. Gear 34 cooperates with a gear 38 which is fixedly attached to an end wall of a single metering capstan 40. Gear 38 and metering capstan 40 have a hollow shaft which is rotatably disposed about tube 22 such that the gear and capstan may be freely rotated with respect to tube 22.

Mounted on the end of tube 22 is a flyer assembly 42 having oppositely extending arms 44 and 46 which are rigidly attached to tube 22. A guide tube 48 is securely mounted on the distal end of arm 44 to guide the twisted rope strand from the metering capstan 40 to a take-up spool 50. Take-up spool 50 may be mounted in any suitable manner but is preferably disposed on a support shaft 52 for rotation thereon with a slight amount of friction drag. A counter weight 54 is mounted on the distal end of arm 46 for balance.

A pulley wheel 56 is mounted on tube 22 such that a portion thereof extends into the interior of the tube. The twisted rope strand from the forming die 16 is guided on pulley 56 out of the interior of tube 22 and around a second pulley wheel 58 mounted on a support 60 carried by arm 44 of the flyer assembly 42. The twisted rope strand continues around pulley wheel 58 and is then wound several times about capstan 40 from which it is fed through tube 48 onto the take-up spool 50, as shown in FIG. 1.

The single capstan 40 has a smooth, cylindrical peripheral wall 62 bounded at each end by flanges 64 and 66. The flanges cooperate to preclude inadvertent dislodgement of the advancing rope from the ends of the capstan. A separating comb 68 is fixedly disposed on arm 44 of flyer assembly 42 and includes at least two teeth 70. The teeth of comb 68 are arranged in a row, the row being aligned substantially parallel with the axis of rotation of capstan 40 with the distal ends of teeth 70 disposed adjacent the peripheral wall 62 so as to engage and maintain separate the adjacent windings of the advancing rope strand.

It should be appreciated that any number of suitable drive assemblies, flyer assemblies and take-up spool assemblies may be utilized in conjunction with the present invention which facilitates the use of a single metering capstan without exhibiting the attendant disadvantages experienced in the prior art.

In operation, the incoming rope strands 20 are fed through forming die 16 to the interior of tube 22. Motor 30 is energized to cause rotation of tube 22 and at the same time causes rotation of capstan 40 in the same direction. Preferably, the gear ratio of the metering capstan is such in relation to the gear ratio of the tube 22 that the capstan rotates slightly faster than the tube albeit in the same direction. The rotational movement of tube 22 causes the advancing rope strands to be twisted together as they pass through the forming die 16 so that they will continue through the tube 22 as a single unit. The twisted rope is then directed around pulley 56 out of the interior of tube 22. The rope then passes around pulley 58 and the peripheral cylindrical wall 62 of capstan 40 from which it is guided through tube 48 to the take-up spool 50. Since the metering capstan 40 is driven at a slightly faster rate than tube 22, the capstan will draw the rope through the assembly as it rotates.

Since the rope only passes around the single capstan 40, it can be accurately controlled so that precise twist and throughput rates can be achieved. Excessive tension, experienced in conventional rope making equipment, will not be applied to the rope since the single capstan functions properly without slippage even under conditions where less than excessive tensile forces are applied. During the advance of rope around the capstan, the protruding teeth 70 of separator bar 68 cooperate to preclude adjacent windings from overlapping or piling up on each other. Each tooth of the comb 68 engages the side of the rope strand at no more than a single point for each winding thereby producing minimum drag and interference. In this manner, binding of the rope is precluded without requiring two capstans or excessive tension.

It should be understood that the single capstan and separator bar assembly of the present invention exhibits reliable and controlled operation not only with twisted rope making machines, but also with other types of rope, cable and the like machines, such as braided rope machines. Thus, the present invention is extremely versatile and is readily adaptable to different types of equipment in which accuracy and control of throughput are desired.

From the foregoing, it can be appreciated that the present invention exhibits several distinct advantages over prior art assemblies particularly in the simplicity of its design, the precise twist and throughput control which can be achieved, and the avoidance of excessive tension in the newly formed rope strand.

Inasmuch as the present invention is subject to many variations, modifications, and changes in detail, it is intended that all matter contained in the foregoing description or shown in the accompanying drawing shall be interpreted as illustrative and not in a limiting sense.

What is claimed is:

1. In combination with a rope making machine in which separate strands of rope are twisted together and drawn through a forming die by a capstan assembly mounted on a frame and then directed by a flyer assembly onto a take-up spool, the improvement wherein said capstan assembly comprises:

a rotatably disposed single capstan having a smooth cylindrical peripheral wall and a hollow central shaft, said capstan including a radially outwardly extending flange on each end of said peripheral wall to preclude an advancing rope strand from slipping off the ends of said single capstan;

means on said frame cooperating with said single capstan to guide the twisted rope strand from said forming die through said hollow capstan shaft and around the peripheral wall of said capstan;

means on said frame for applying a driving force to rotate said single capstan; and a separating comb fixedly carried on said flyer assembly with the teeth thereof arranged in a row, said row aligned substantially parallel to the capstan axis with the distal ends of said teeth disposed adjacent the peripheral wall of said capstan such that adjacent windings of the advancing rope strand on said single capstan are engaged at no more than a single point on a side of said strand for each winding and kept separate by the comb teeth and thereby are prevented from overlapping and binding.

2. The combination as recited in claim 1 wherein said guide means comprises at least one pulley disposed on the flyer assembly adjacent said single capstan.

3. The combination as recited in claim 1 wherein said driving means includes a toothed wheel fixedly attached to an end wall of said capstan for imparting rotary movement thereto.

4. The combination as recited in claim 1 wherein said flyer assembly is attached to a rotatable, hollow tube, and said capstan is rotatably mounted on said tube; said driving means being coupled to rotate both said tube and said capstan with the rotational speed of the capstan greater than that of said tube.

5. The combination as recited in claim 1 wherein said separating comb has at least two teeth.

6. A method of making rope in which separate strands of rope are joined together and drawn through a forming die by a single metering capstan having a smooth cylindrical periphery, and then directed onto a take-up spool, the improvement comprising the steps of:

directing the joined strands around the peripheral wall of the single metering capstan;

driving the capstan so as to rotate the same and to draw the rope strands thereabout; and separating adjacent windings of the rope strands by a separating comb having teeth arranged in a row, said row aligned substantially parallel to the capstan axis with the distal ends of said teeth disposed adjacent the peripheral wall of the single capstan for engaging said rope at no more than a single point on a side of said strand for each winding.

7. The method as recited in claim 6 wherein said capstan has a hollow shaft; and wherein the joined strands are first directed through said hollow shaft and then around the peripheral wall.

8. In combination with a rope making machine in which separate strands of rope are joined and drawn through a forming die by a capstan assembly mounted on a frame and then directed onto a take-up spool, the improvement wherein said capstan assembly comprises:

a single capstan rotatably disposed on the frame and having a smooth cylindrical peripheral wall, said capstan including a radially outwardly extending flange on each end of said peripheral wall to preclude an advancing rope strand from slipping off the ends of said single capstan;

means on the frame cooperating with said single capstan to guide the joined strands of rope from said forming die around the peripheral wall of said capstan;

means on the frame for applying a driving force to rotate said single capstan; and a separating comb supported from the frame with the teeth thereof arranged in a row, said row aligned substantially parallel to the capstan axis with the distal ends of said teeth disposed adjacent the peripheral wall of said capstan such that adjacent windings of the advancing rope on said single capstan are engaged at no more than a single point on a side of said strand for each winding and kept separate by the comb teeth and thereby are prevented from overlapping and binding.

9. The combination as recited in claim 8 wherein said guide means comprises at least one pulley; and wherein said separating comb has at least two teeth.

* * * * *